US005427504A

United States Patent [19]

Dinning et al.

[11] Patent Number: 5,427,504

[45] Date of Patent: Jun. 27, 1995

[54] GAS OPERATED PLUNGER FOR LIFTING WELL FLUIDS

[76] Inventors: Robert W. Dinning, 9901 Westview, Houston, Tex. 77055; Joseph B. Heath, Jr., Rt. 1, Box 762, Pointblank, Tex. 77364

[21] Appl. No.: 165,661

[22] Filed: Dec. 13, 1993

[51] Int. Cl.[6] ..... F04B 47/12

[52] U.S. Cl. ..... 417/59; 417/60

[58] Field of Search ..... 417/56, 57, 58, 59, 417/60

[56] References Cited

U.S. PATENT DOCUMENTS

| | | | |
|---|---|---|---|
| 2,674,951 | 4/1954 | Zaba | 417/59 |
| 2,970,547 | 2/1961 | McMurry | 417/60 X |
| 3,090,315 | 5/1963 | Milton | 417/60 |
| 3,249,056 | 3/1966 | Lyles | 417/59 |
| 4,030,858 | 6/1977 | Coles | 417/56 |

*Primary Examiner*—Richard E. Gluck
*Attorney, Agent, or Firm*—Bill B. Berryhill

[57] ABSTRACT

A gas operated plunger for lifting well fluids from a subterranean reservoir to the surface through a well conduit comprising: a plunger body slidably mountable within the conduit having an upper portion, a lower portion and an intermediate cylindrical portion of reduced diameter; and a sealing assembly surrounding the intermediate cylindrical portion of the plunger body. The sealing assembly may include a plurality of longitudinally divided cylindrical segments of relatively smooth cylindrical surfaces for sliding and sealing contact with the well conduit walls to provide a seal which allows the plunger to gravitate through the well conduit to the reservoir and provides sufficient sealing upon an increase in gas pressure therebelow to elevate the plunger and well fluids thereabove to the surface.

18 Claims, 4 Drawing Sheets

GAS OPERATED PLUNGER FOR LIFTING WELL FLUIDS

BACKGROUND OF THE INVENTION

1. Field of the Invention

The present invention relates to apparatus for lifting well fluids from a subterranean reservoir. More specifically, the present invention pertains to gas operated plunger apparatus for lifting well fluids from a subterranean reservoir through a well conduit which extends to the surface. In particular, the present invention pertains to plunger apparatus which is suitable for lifting well fluids from a subterranean reservoir with relatively low gas pressures.

2. Description of the Prior Art

Gas operated plungers or pistons, have, for many years been utilized in producing subterranean wells where the natural gas pressure in the well is insufficient to produce a free flow of liquids to the surface. Such prior art devices generally include a plunger or piston element which is slidably and sealably engaged with a well conduit which extends upwardly from the well reservoir to the surface. The well conduit, normally referred to as a production string, may be either a casing string or a tubing string disposed within a casing string.

Typically, a gas operated plunger is provided with external sealing elements for sealingly and slidingly engaging the inner walls of the well conduit. However, the plunger is also typically provided with an internal passage which bypasses the external sealing elements and allows the plunger to gravitate or fall from the surface of the well to the reservoir. A valve mechanism is typically provided within the body of the plunger and is effective to close the internal passage through the plunger when the plunger has reached a preselected depth in the well. This preselected position may be determined by a stop device, sometimes referred to as a tubing stop, which is semi-permanently located in the well conduit. The tubing stop may be relocated, from the surface of the well, at different depths as well conditions change.

When the plunger reaches the tubing stop, contact with the stop causes the valve mechanism to close, blocking the internal passage through the plunger. The plunger remains in this position while well fluids accumulate above the plunger and gas pressure begins to build. After a preselected time, a control valve at the surface of the well opens, allowing flow of fluids to commence. The drop in pressure above the plunger allows higher pressures below the plunger to force it and the well fluids thereabove to the surface. On arrival of the plunger at the surface, the plunger valve opens, opening the internal flow passage through the plunger, and the control valve is closed. This allows the plunger to gravitate to the bottom of the well conduit until stopped by the tubing stop. The plunger valve is again closed and the next cycle begins. Examples of such gas operated plunger apparatus may be seen In U.S. Pat. Nos. 4,070,134 and 4,923,372.

Most gas operated plungers of the prior art have inherent problems. One problem is with the seal between the plunger and the inner walls of the well conduit. This seal must be capable of sliding past restrictions within the well conduit yet slidingly and sealingly engageable with the inner walls of the conduit sufficiently to provide the pressure differential necessary for elevating the plunger and well fluids thereabove to the surface of the well and capable of doing so without undue damage to the seal. This type of seal frequently comprises a plurality of metallic pads or segmented cylindrical surfaces provided on a plurality of longitudinally separated cylindrical segments surrounding the plunger body. These pads or segments are radially moveable between an innermost position and an outermost position so that the seal may contract as it passes through restricted portions of the well conduit and may expand to sealingly and slidingly engage the well conduit to provide the necessary seal. Typically, some type of biasing means is provided to bias the sealing elements or pads toward their outermost positions. However, when the pads are in the outermost expanded positions a considerable amount of leakage and bypassing occurs between the interior surfaces of the pads and the plunger body. This, of course, increases the pressure necessary to elevate the plunger and well fluids from the subterranean formation to the surface of the well. Furthermore, this flow and leakage by the seal elements and the plunger body creates erosion that will erode the plunger body and the sealing elements, further increasing the pressure necessary to elevate the plunger and well fluids to the surface of the well and eventually eroding these elements to such an extent that they are no longer useable, requiring repair and/or replacement at considerable expense. In addition, in the plunger apparatus designs of the prior art, the seals inherently leak through the spaces between adjacent segments or pads. These spaces are wider and leak more as the internal diameter of the well conduit increases, as is Frequently the case with the upper portions of a well conduit. This type of leakage increases the pressure necessary for lifting of the plunger and well fluids, requires more plunger trips, and also results in erosion of the sealing elements or pads and plunger body so that the sealing elements and/or the plunger body may eventually have to be replaced.

In many gas operated plungers of the prior art, particularly those in current use, a rod is concentrically mounted in the internal flow passage therethrough. The purpose of the rod is to reopen the plunger valve when it reaches the surface of a well. Typically, the rod would engage a spring loaded stop at the surface of the well causing the rod to move downwardly to engage a valve closure member, unseating the closure member and opening the valve. Such a design severely restricts flow through the internal flow passage as the plunger is falling back to the bottom of the well. In some conditions, it restricts the flow to such an extent that the plunger will not fall without added weight. This type of design is costly, requires corrections for the additional moving weight and creates other hazards for the plunger as it returns to the surface. Fluid flow through the plunger should be maintained at an uninterrupted maximum. If not, the plunger will fall erratically and may not reach the depth required to close the plunger valve. If the valve does not close, the plunger will not return to the surface of its own accord, requiring a costly fishing operation to retrieve the plunger. In addition to the above mentioned problems, the rod provided to the valve is necessarily small, fragile and susceptible to damage.

Some designs have attempted to solve the problems associated with a rod in the internal flow passage of the plunger by providing a rod in a lubricator bumper sub typically installed at the upper end of the well conduit.

Such a rod is designed to penetrate the plunger flow passage to contact the valve closure member and push it off its seat at the instant the plunger contacts a spring loaded stop in the lubricator bumper sub. This requires accurate and sensitive adjustments which are not always possible in field situations. Furthermore, there are many hazards and damage possibilities when the plunger, traveling under pressure, is propelled against a stationary rod. There are so many disadvantages of this design, that very few well operators utilize it.

SUMMARY OF THE PRESENT INVENTION

The present invention provides a gas operated plunger for lifting well fluids from a subterranean reservoir through a well conduit which extends to the surface. The plunger comprises: a plunger body slidably mounted within the well conduit and having an intermediate cylindrical portion of reduced diameter, which, with the inner walls of the well conduit in which the plunger is to be used, defines a cylindrical space, and sealing means for disposition in the cylindrical space which includes an outer seal comprising a plurality of longitudinally divided cylindrical segments of relatively rigid material the exterior surfaces of which provide relatively smooth cylindrical surfaces for sliding and sealing contact with the well conduit walls. The sealing means provides a seal which provides sufficient sealing upon an increase in gas pressure to elevate the plunger and well fluids thereabove to the surface of the well. Adjacent edges of adjacent ones of the cylindrical segments are provided with overlapping or stepped opposing surfaces which are slidingly engageable with each other as the cylindrical segments move radially between inwardly contracted and outwardly expanded positions.

In a preferred embodiment of the invention there is no passage through the plunger body. There is, by design, enough leakage by the sealing means to allow the plunger to gravitate through the well conduit to the reservoir. However, this leakage is not so great as to prevent sufficient sealing upon an increase in gas pressure to elevate the plunger and well fluids thereabove to the surface. In an alternate design of this embodiment, the sealing means also includes an inner annular flexible seal the interior of which sealingly engages the intermediate portion of the plunger body and the exterior of which sealingly engages interior surfaces of the outer seal cylindrical segments so as to substantially prevent fluid (gas and/or liquids) from bypassing between the plunger body and the interior surfaces of the outer seal cylindrical segments, decreasing the pressure necessary for elevating the plunger and the well fluids to the surface.

In another embodiment of the invention a longitudinal flow passage is provided through the plunger body and a valve is attached to the lower portion of the plunger body. The valve has a flow passage in flow communication with the plunger body flow passage and a closure member moveable between an open position, in which fluid flow is permitted through the valve and the plunger body flow passages, and a closed position in which fluid flow is blocked, allowing gas pressure to elevate the plunger and well fluids to the surface. In a preferred embodiment of this design, the valve body is provided with a pocket to one side of the valve flow passage in which the closure member is disposed when in the open position so as not to interfere with fluid flow through the valve. The valve may also include actuator means engageable with the closure member and moveable in response to a force applied thereto to move the closure member from its open position in the pocket to a closed position sealingly engaging a valve seat.

The gas operated plunger of the present invention provides sealing elements which are unique in design and provide efficient sealing against the inner walls of a well conduit of somewhat variable diameter. Such sealing is provided without undue leakage or bypassing, reducing the pressures necessary for elevating the plunger and well fluids thereabove as well as reducing potential damage from erosion. In one embodiment of the invention, a unique inner seal is provided between the plunger body and the inner surfaces of the outer seal, further reducing any bypass leakage and further reducing pressures necessary for elevating the plunger and well fluids thereabove. In another embodiment of the invention, the plunger body is provided with a longitudinal flow passage and a valve by which the flow passage can be opened and closed. The valve is of a unique design which does not require a rod in the plunger body flow passage or a rod at the surface of the well to open the valve, as with prior art.

The unique plunger designs of the present invention thus provide reduced leakage, reduced operating pressures, reduced damage from erosion and substantially trouble free operation. Many other objects and advantages of the invention will be apparent from reading the description which follows in conjunction with the accompanying drawings.

DESCRIPTION OF PREFERRED EMBODIMENTS

Figure 1:
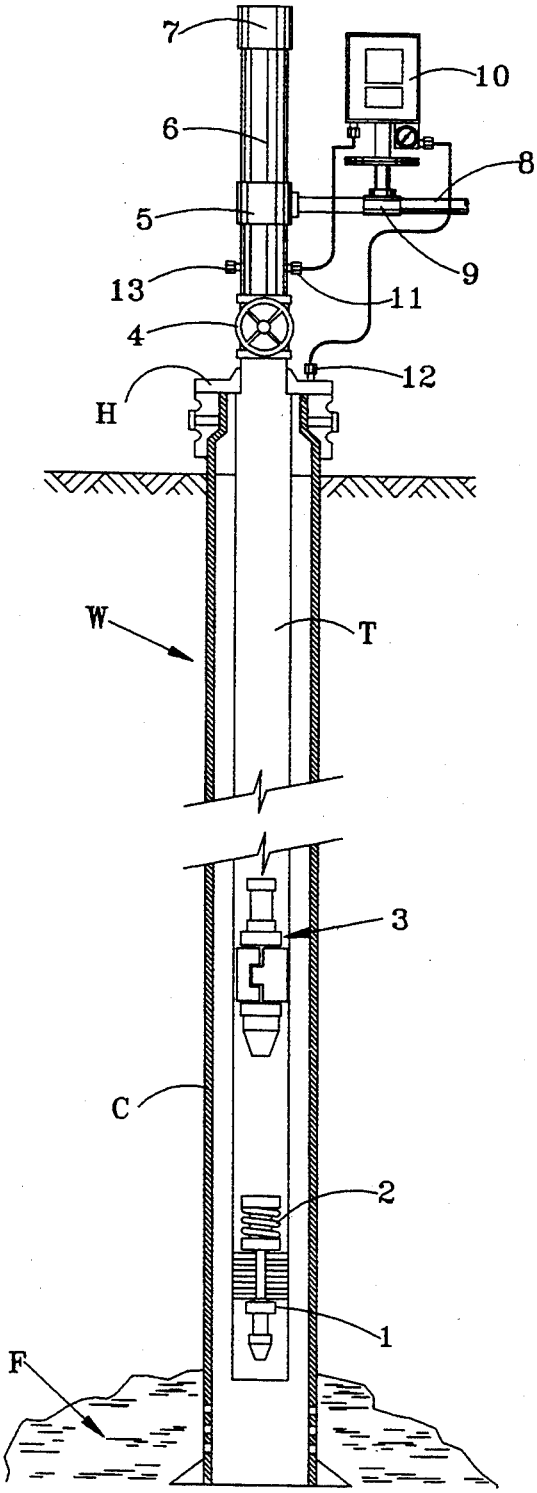
FIG. 1 is a schematic representation of a well installation, illustrating production of the well by utilizing a gas operated plunger according to a preferred embodiment of the invention.

Referring first to FIG. 1, there is shown a well W for producing hydrocarbon fluids from a subterranean formation F. One or more well conduits extend from the subterranean formation F to the surface. In the exemplary embodiment there is a casing string C, at the upper end of which is a well head H, and a tubing string T. The tubing string T, which may be referred to as the production string, sometimes exists without a casing string. In any event, the tubing string T is the well conduit through which fluids from the subterranean formation F flow or are raised to the surface.

Near the bottom of the tubing string T is a stop mechanism 1 mounted in a conventional manner by slips or any other suitable manner. The stop mechanism 1 may be relocated by wire line operations or the like, from the surface of the well W, at different depths as well conditions change. The stop mechanism 1 would preferably incorporate a spring 2 of some type for arresting downward movement of a plunger type pump unit 3 which is slidably and sealably disposed in the tubing spring T and which will be described in greater detail hereafter.

At the surface of the well W is a master cutoff valve 4 suitably secured to the tubing string T to totally block the flow of fluids from the tubing string T when desired. This will also allow retrieval of the plunger pump 3 for inspection or repair. Above the valve 4 is a flow tee 5 and a lubricator bumper sub 6 closed at its upper end by detachable end cap 7. The bumper sub 6 is conventionally provided therein with a spring member (not shown) which is engageable by the plunger pump 3 when rising through the tubing string T to arrest movement of the plunger 3 and cushion the shock created thereby.

Connected to the flow tee 5 is a flow line 8 in which is installed a control valve 9. A controller 10 is provided for operating the control valve 9. The controller 10 is also connected to a plunger sensing device 11 and a pressure fitting 12 for sensing the pressure within the wellhead H. A plunger catching device 13 may also be attached to the tubing string above valve 4.

Figure 2:
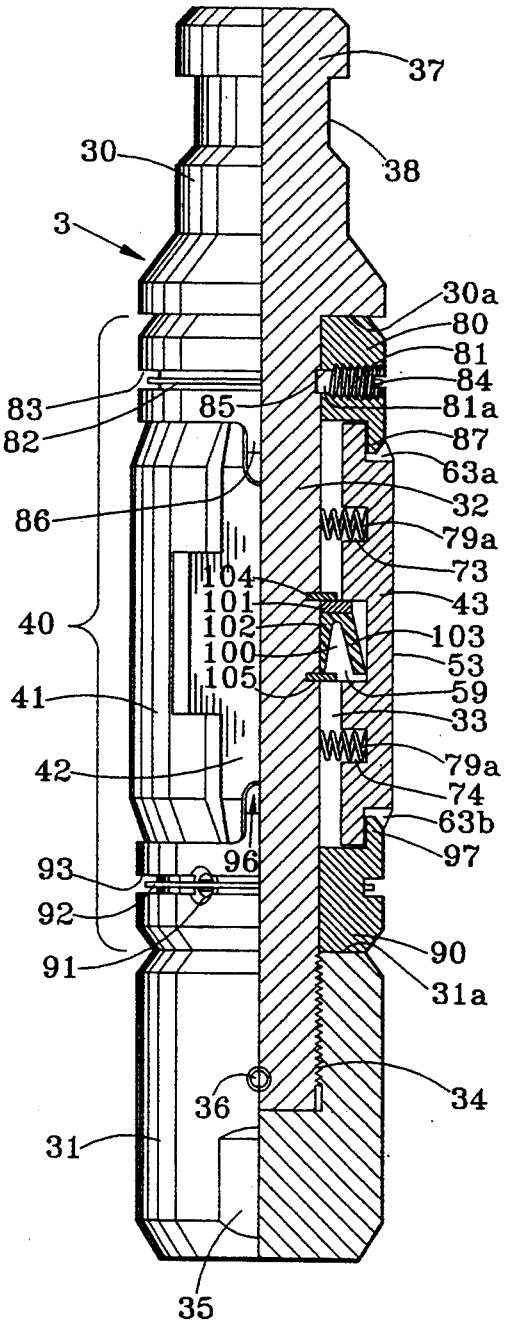
FIG. 2 is a longitudinal view, in quarter section, of a gas operated plunger according to a preferred embodiment of the invention.

Referring now also to FIGS. 2–8, the plunger pump 3 will be described in more detail. The plunger 3 has a plunger body made up of an upper portion 30, a lower portion 31 and an intermediate cylindrical portion 32 of reduced diameter so that the outer surface of the intermediate portion 32 defines the inner limits of an annular space 33. Actually, the lower portion of the plunger body, in the embodiment of FIG. 2, is provided by a plug or cap 31 which may be threadedly connected at 34 with corresponding threads on the lower end of the intermediate body portion 32. The cap may be provided with wrench flats 35 for aiding in the engagement or disengagement of the threaded connection 34 and a set screw 36 which may be tightened when the cap is fully engaged as in FIG. 2 to prevent accidental loosening or disengagement.

The upper portion 30 of the plunger body may include a head 37 and reduced diameter neck 38 for engagement by a fishing tool if it ever becomes necessary to mechanically retrieve the plunger 3 from the well. Surrounding the intermediate cylindrical portion 32 of the plunger body and disposed in the annular space 33 therearound is a sealing assembly 40. The sealing assembly 40 comprises a plurality, four in the exemplary embodiment, of longitudinally divided cylindrical segments 41, 42, 43, 44. These segments 41, 42, 43, 44, of relatively rigid material (metal, hard rubber, plastic, etc.) are formed with relatively smooth outer cylindrical surfaces for sliding and sealing contact with the walls of the well conduit in which the plunger 3 is to be used, for example the inner walls of the tubing string T in FIG. 1.

Figure 3:
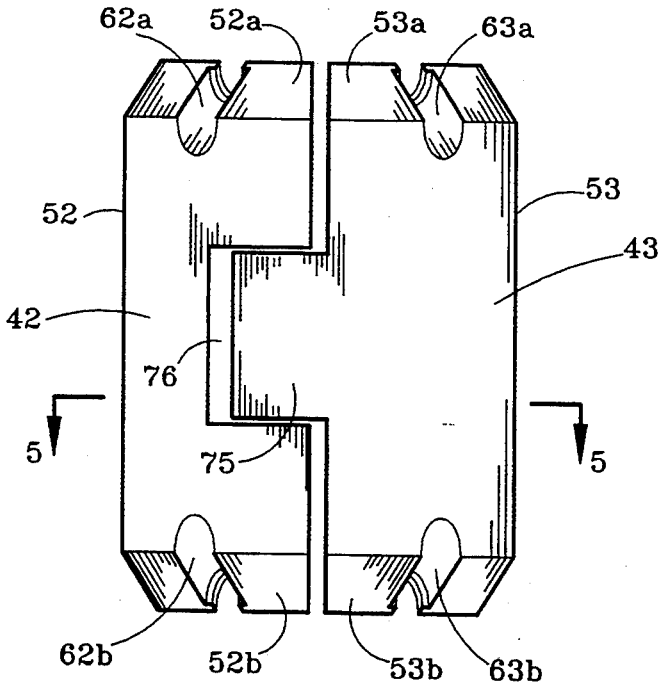
FIG. 3 is a longitudinal view of four seal segments which cooperate to form sealing means for use with the preferred embodiment of FIG. 2.
Figure 4:
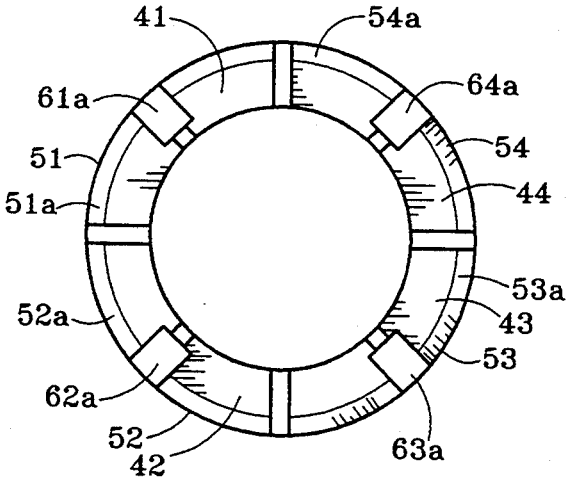
FIG. 4 is an upper end view of the four seal segments of FIG. 3.
Figure 5:
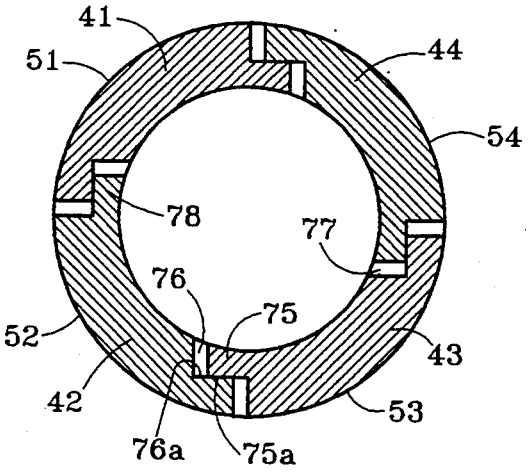
FIG. 5 is a sectional view of the four seal segments of FIG. 3, taken along lines 5—5 thereof.
Figure 6:
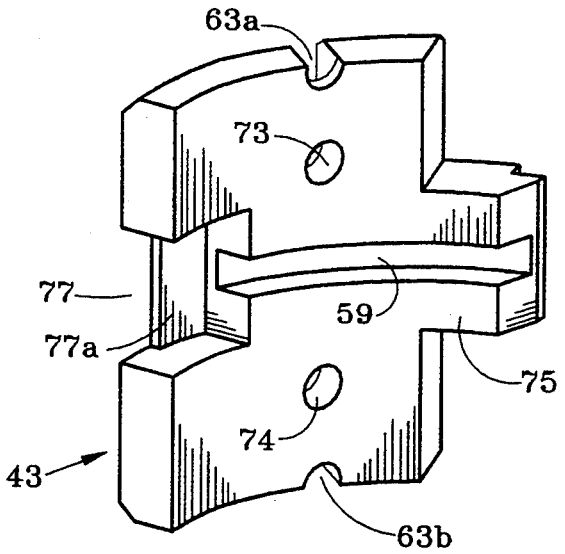
FIG. 6 is an inner perspective view of one of the four seal segments of FIGS. 3–5.
Figure 7:
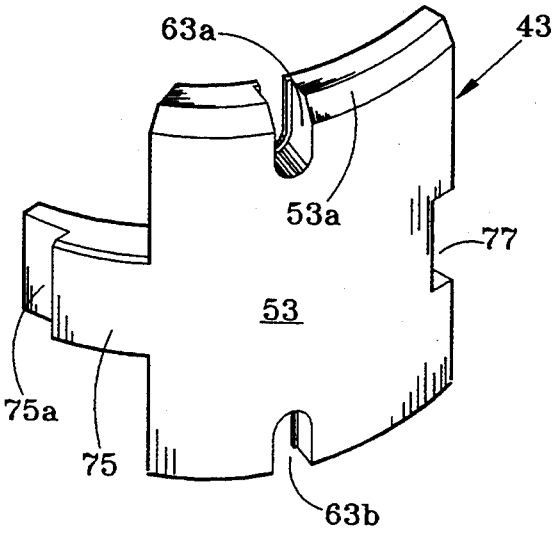
FIG. 7 is an outer perspective view of the seal segment of FIG. 6.
Figure 8:
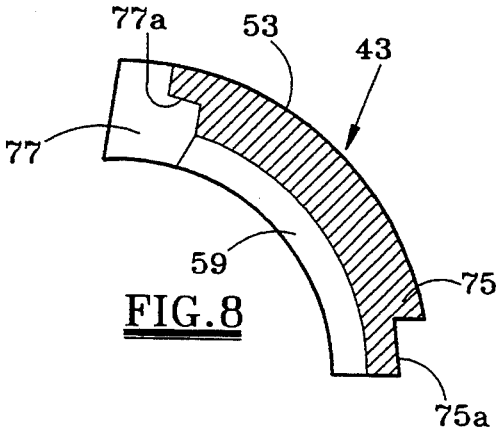
FIG. 8 is a cross-sectional view of the seal segment of FIGS. 6 and 7, taken across the mid-section thereof.

Four of these segments 41, 42, 43, 44 are shown In FIGS. 3–5 hereof. One of the segments 43 is in perspective and cross-section in FIGS. 6–8. FIG. 4 is an upper end view of the segments 41–44. FIG. 5 is a section view of the segments 41–44. Each of these segments 41, 42, 43, 44 is provided with a generally smooth outer cylindrical surface 51, 52,53,54, respectively. The upper and lower ends of these segments are inwardly tapered as at 51*a*, 52*a*, 53*a*, 54*a*, and 51*b*, 52*b*, 53*b*, 54*b*, respectively. The inner surfaces of the segments 41, 42, 43, 44 are also generally cylindrical in shape and provided near the mid area thereof with a circular groove such as the groove 59 of segment 43 as best seen in FIGS. 2, 7 and 8. There is provided at the upper and lower ends of each segment a semi-circular notch 61a, 62*a*, 63*a*, 64*a* and 61*b*, 62*b*, 63*b*, 64*b*, respectively. The interior of each segment is provided with upper and lower blind holes such as holes 73, 74 for the segment 43 of FIGS. 2 and 6.

Adjacent edges of adjacent ones of the segments are provided with corresponding circumferentially and mutually engageable tabs and slots, a tab on one of the adjacent cylindrical segments and a slot on the other. For example in FIG. 3 and 5, segment 43 has a tab 75 which is for engagement with a slot 76 of segment 42. The opposite edges of these segments may be provided with slots 77 and tabs 78, respectively. See also segment 43 in FIGS. 5–8. These tabs and slots have stepped areas so that a portion of a tab overlaps an inset portion of a corresponding slot. The overlapping is accomplished with opposing surfaces, e.g. 75*a* and 76*a*, which are slidably engageable with each other as the cylindrical segments 41–44 move between their innermost and outermost positions. These overlapping opposing sealing surfaces are planar surfaces which are tangentially disposed relative to a cylinder whose axis corresponds with the axis of the intermediate cylindrical portion 32 of the plunger body about which the segments are disposed.

The sealing segments 41, 42, 43, 44 are held in place around the cylindrical portion 32 of the plunger body by an upper retainer ring 80 and a lower retainer ring 90. The upper retainer ring 80 is slipped over the intermediate portion 32 of the plunger body with the plug or cap 31 removed until it abuts an annular shoulder 30*a* of the plunger body. It may be held in place by a set screw 81. A spring ring 82 engages a groove 83 in the retainer ring 80 and a slot 84 in the end of set screw 81 to prevent displacement of the retainer ring 80. It will be noted that a blind hole 85 is provided in the intermediate cylindrical portion 32 of the plunger body for engagement by a cylindrical end 81*a* of the set screw 81. This hole is precisely located to orient four downwardly projecting lugs, such as lugs 86 and 87 which are spaced at ninety degree intervals around the retainer ring 80 to engage corresponding guide notches at the upper ends of the cylindrical segments 41, 42, 43, 44 (see for example guide notches 61*a*–64*a* in FIGS. 2, 3 and 4).

The lower retainer ring 90 abuts an annular shoulder 31*a* of the cap 31. The lower retainer ring 90 is likewise provided with a set screw 91 and a locking ring 92 which engages the groove 93 and a slot provided in the outer end of the set screw 91 to hold the lower retainer ring 90 in proper orientation for upwardly extending guide lugs 96 and 97 which engage corresponding guide notches in the lower ends of the cylindrical segments 41, 42, 43, 44 (see for example the guide notches 62*b* and 63*b* in FIGS. 2 and 3).

As best understood by viewing FIG. 2, the cylindrical segments 41, 42, 43, 44 are radially moveable between an innermost position, in which the external cylindrical surfaces thereof lie within a circle whose diameter is less than the outer diameter of the retainer rings 80 and 90 and all of which are less than any restriction which may be encountered within the well conduit in which the plunger is to be used, and an outermost position, such as illustrated in FIG. 2, in which the exterior cylindrical surfaces of the segments 41, 42, 43, 44 would slidingly and sealingly engage the walls of the well conduit in which the plunger is to be used. Biasing springs 79*a*, 79*b*, etc. placed in blind holes 73, 74 etc. bias these segments toward their outermost position. However, if the segments encounter a restricted area when traveling through a well conduit, the tapered ends 51*a*–54*a* and 51*b*–54*b*, depending upon the direction of travel, overcome this bias, forcing the segments toward their innermost positions.

Although the plunger 3 could be used without such, it is preferably provided with an internal sealing assembly which includes an annular contractible and expandable flexible seal 100, the interior of which sealingly engages the intermediate portion 32 of the plunger body and the exterior of which sealingly engages interior surfaces of the cylindrical segments 41, 42, 43, 44. In the exemplary embodiment, the seal is disposed in the interior grooves 59 provided therefor on the inner sides of the segments 41, 42, 43, 44. Although it can be made of several materials and in a number of configurations, the flexible seal 100 of the exemplary embodiment comprises a relatively rigid (such as metal) head area 101 and a cylindrical body portion 102 which actually surrounds the intermediate portion 32 of the plunger body. A downwardly and outwardly flaring skirt portion 103 (preferably a resilient material) engages the interior surfaces of the cylindrical segments 41, 42, 43, 44. Upper and lower retainer rings 104 and 105 mounted in corresponding grooves of the intermediate body portion 32 of the plunger help prevent the seal 100 from being extruded or forced into the annular areas between the segments 41, 42, 43, 44 and the intermediate cylindrical portion 32. It is easily understood that increased pressure below the seal 100 would be translated to the skirt portion 103 as an increased sealing and outwardly biasing force against the cylindrical segments 41, 42, 43, 44. Again, it should be understood that in some wells it may not be necessary to have an internal sealing assembly such as the seal 100, the plunger 3 operating only with the outer sealing assembly 40.

Referring especially now to FIGS. 1 and 2, the operation of the plunger pump 3 will be explained. The plunger pump 3 is preferably used in wells where the gas pressure alone is insufficient to flow or produce significant fluids at the surface. Hydrocarbons from many such wells cannot be recovered except through the installation of conventional sucker rod or submersible pumps with considerable expense, daily inspection and maintenance required by such units. Furthermore, in wells producing primarily gas, gas production may be substantially impaired by liquids accumulating in the bottom of the well, whether such liquids are hydrocarbons or salt water. In either event, it is desirable to remove liquids from the bottom of such well without installing conventional pumping units.

Initially, the plunger 3 is placed in the production string T through the lubricator sub 6. This is done by removing the cap 7 while the valve 4 is closed. Then the cap 7 is replaced, the valve 4 opened, and the plunger 3 allowed to gravitate or fall to the bottom of the well through the tubing string T. Although the sealing segments or pads 41, 42, 43, 44 are biased outwardly for sliding and sealing engagement with the interior of the well conduit T, and although the internal seal assembly 100 sealingly engages the intermediate plunger body 32 and the surfaces of the sealing segments 41, 42, 43, 44, there is a small amount of leakage through the small areas between the edges of the sealing segments 41, 42, 43, 44. This permits the plunger to fall under its own weight toward the tubing stop 1 which will eventually arrest its downward movement. As this occurs, the motor operated valve 9 is closed and a time sequence is initiated by the controller 10.

Fluids enter the production string T and gas pressure begins to build. The controller 10 is programmed to keep the valve 9 closed until substantial fluids have entered the production string T and sufficient gas pressure has built up. The amount of time necessary will be different for every well and may change over the life of the well. However, after a pre-determined amount of time, the controller 10 opens the valve 9, substantially reducing pressure above the plunger 3 so that the accumulated gas pressure therebelow forces the plunger 3 and the fluids trapped thereabove upwardly through the well conduit or production string T through the flow tee 5, the valve 9 and the production piping 8 for production of the well.

As the plunger 3 is propelled upwardly through the tubing string T, it passes through the valve 4, is sensed by the sensor 11 and eventually movement thereof is arrested by the spring (not shown) in the lubricator sub 6. When the plunger 3 is detected by the sensor 11, a signal is transmitted to the controller 10 which, initiates closure of the valve 9. Then the plunger 3 is allowed to again fall or gravitate to the bottom of the well so that the cycle may be repeated.

Although the plunger 3 of the present invention is capable, under some circumstances, of operating without the inner seal assembly 100, it is most efficient and effective with this unique seal. Without the inner seal assembly 100, the plunger 3 may be operable at a differential pressure of e.g., 150 psi. However, with the internal seal assembly 100, the differential pressure necessary for operation may be reduced to e.g., in the range of 50 psi. The uniqueness of the interior seal 100 and the design of the sealing segments 41, 42, 43, 44 with their mutually engageable edge tabs and slots and the tangentially disposed overlapping opposing planar surfaces thereon makes this plunger substantially more effective and efficient than those of the prior art.

Figure 9:
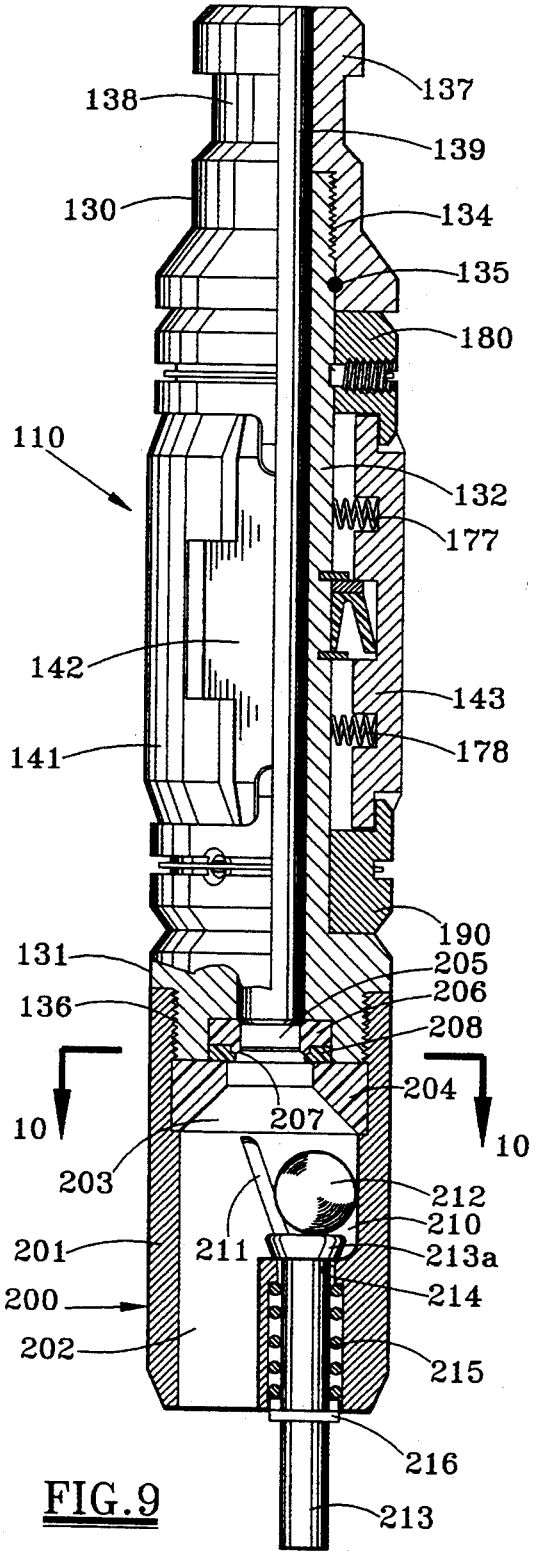
FIG. 9 is a partially sectioned longitudinal view of a gas operated plunger utilizing a valve, according to another preferred embodiment of the invention.
Figure 10:
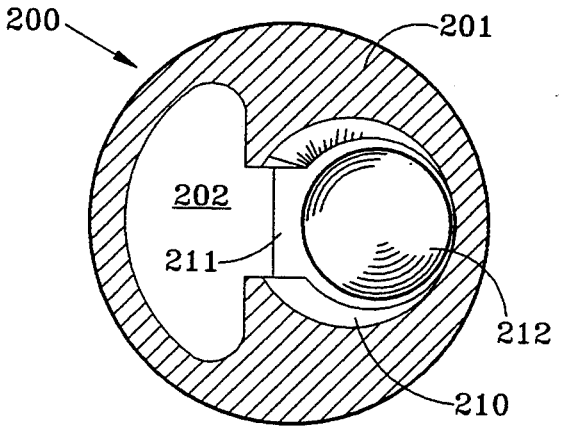
FIG. 10 is a sectional view of the valve portion of the plunger apparatus of FIG. 9, taken along lines 10—10 thereof.
Figure 11:
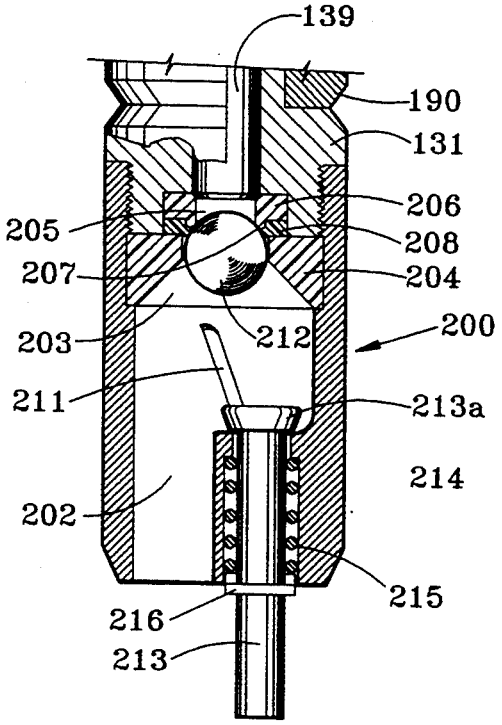
FIG. 11 is a partially sectioned longitudinal view of the lower portion of the plunger of FIGS. 9 and 10 showing the valve thereof in closed position.

FIGS. 9, 10 and 11 illustrate an alternate preferred embodiment of the invention which in many respects is the same as the embodiment of FIGS. 1–8. Like in the previous embodiment, the plunger 110 of FIGS. 9, 10 and 11 has a plunger body having an upper portion 130, a lower portion 131, and an intermediate cylindrical portion 132. The upper portion 130, like in the previous embodiment, is provided with a head area 137 and a reduced neck 138 for engagement by a fishing tool if required. The upper portion 130 of the plunger body, in this embodiment, is a separate piece threadedly connected to the intermediate body portion 132 at a threaded connection 134. A seal 135 may be provided to seal this connection. The lower body portion 131 is provided with an external thread which in cooperation with a corresponding internal thread on a valve assembly 200 provides a threaded connection 136 between the plunger body portions 130, 131, 132 and the valve assembly 200 which will be more fully described hereafter. As noted, the plunger body is provided with a central flow passage 139. It is the central flow passage 139 and the valve assembly 200 which is the major difference between the plunger of FIGS. 9–11 and the previously described plunger of FIGS. 1–8.

Like in the previously described embodiment, the plunger of FIGS. 9–11 is provided with an outer seal assembly made up of a plurality of longitudinally divided cylindrical segments 141, 142, 143, etc. which are substantially identical to the corresponding elements in the embodiments of FIGS. 1–8. Retainer rings 180 and 190 hold these segments in place but permit their radial movement between an innermost position, in which the exterior cylindrical surfaces thereof lie within a circle whose diameter is less than any restriction to be encountered in the flow conduit with which it is to be used, and an outermost position in which the exterior cylindrical surfaces thereof slidingly and sealingly engage the walls of the well conduit in which the plunger 110 is to be used. Springs 177 and 178 bias these segments toward their outermost position. The unique circumferentially and mutually engageable tabs and slots and the overlapping opposing tangentially disposed planar surfaces provided by stepped areas thereon allow radial inward and outward movement while limiting leakage and erosion caused thereby.

The valve assembly 200 has a cylindrical valve body 201, which as previously mentioned, is threadedly connected to the lower plunger body portion 131 at the threaded connection 136. The valve body 201 has an offset flow passage 202 which communicates with the flow passage 139 of the plunger body through the frusto-conical port 203 of a flow transition member 204 and the port 205 of a valve seat member 206. The valve seat member 206 is provided with a downwardly facing and tapered valve seating surface 207. An elastomeric seal 208 may be provided between the valve seat 206 and the transition member 204. The valve body 201 is also provided with an offset pocket area 210 partially defined by a slanted or tapered ramp area 211. The pocket area 210 is sized and designed to receive a ball-type closure member 212 which under certain conditions, is moveable between the open position of FIG. 9, in which fluid flow is permitted through the valve 200 and the plunger body flow passage 139, and a closed position as in FIG. 11, in which fluid flow through the valve flow passage 202 and the plunger body flow passage 139 is blocked.

The valve 200 is also provided with an actuator which includes a rod 213 at the upper end of which is a tapered head member **213*a*. The rod extends through a hole 214 communicating with the pocket 210 and projects from the lower end of the valve body 200. A spring 215 surrounds the rod 213 and is placed and held in compression by a spring retainer 216 so that the head 213*a* and rod 213 are biased toward the lowermost position of FIG. 9. However, if an upwardly directed force of sufficient magnitude is directed against the rod 213, the head 213*a*, which engages the ball closure member 212, will force the ball out of the pocket 210 toward engagement with the valve seat 206 as illustrated in FIG. 11**.

The plunger of the embodiment of FIGS. 9–11 operates much as the plunger embodiment of FIGS. 1–8 and may be described with reference to FIG. 1. Like the plunger 3 of FIGS. 1 and 2, the plunger 110 of FIGS. 9–11 may be placed in the tubing string T and allowed to fall or gravitate to the bottom of the well W for producing the subterranean formation F thereof. As this occurs, the actuator rod 213 and the head member **213*a* thereof are biased toward a downward position and the ball closure member 212 (due to gravity) is in the side pocket 210 as shown in FIG. 6. This assures bypassing of fluids through the valve passage 202 and the plunger body passage 139 as the plunger 110 falls in the tubing string T. When the plunger 110 reaches the tubing stop 1 at the bottom of the production string T, its movement is arrested by shock spring 2 and the lower end of the actuator 213 encounters the fishing neck of the spring 2. The weight of the plunger 110 further compresses the spring 215, forcing the rod 213, its head 213*a* and the ball closure member 212 in an upward direction. As soon as the ball closure member 212 enters the flow path of valve passage 202, 203, 205, and the plunger body flow passage 139, it is forced, not only by the actuator 213, but by the flow of fluids to assume its closed position engaging the seating surface 207 as illustrated in FIG. 11. At this point, the bypassing of fluid through the plunger body flow passage 139 is blocked and gas pressure is allowed to build up just as with the plunger 3 of the embodiment illustrated in FIGS. 1–8**.

After a pre-selected, pre-determined period of time, the control valve 9 at the surface is opened by the controller 10 and the gas pressure built up in the well causes the plunger 110 and any well fluids accumulated in the tubing string T thereabove to be elevated to the surface and produced through the production line 8. Once the plunger 110 is detected by sensor 11 and the control valve 9 closed by the controller 10, pressure is equalized in the area of the lubricating sub 6. The actuator rod 213 has already returned to the position of FIG. 9 under the influence of spring 215 and the ball closure member 212, due to its own weight, reassumes its open position of FIG. 9. The flow passages 202 and 139 are again opened allowing the plunger 110 to descend to the bottom of the well W for repeating the cycle.

The plunger of the present invention has a number of unique elements. Perhaps the most unique is the design of the segmented sealing elements which slidingly and sealingly engage the inner walls of the well conduit in which the plunger is used. These segmented sealing elements are provided with unique circumferentially and mutually engageable tabs and slots which have overlapping opposing surfaces, preferably tangentially disposed, which are slidingly engageable with each other as the segments move between innermost and outermost positions. Unique design of these segments reduces bypass leakage and the erosion concomitant therewith which exist in designs of the prior art. Furthermore, Leakage between the inner surfaces of these segmented elements and the portion of the plunger body which they surround is substantially eliminated by an interior seal which sealingly engages the plunger body and the opposing surfaces of the segments. In one preferred embodiment of the invention, a unique valve assembly is provided which allows bypassing of fluids through the plunger body when desired but which blocks such flow to allow the plunger and fluids thereabove to be elevated to the surface. The valve is provided with a unique side pocket arrangement for disposition of the valve closure member in the valve open position.

Two embodiments and variations thereof have been described herein. However, many variations of the invention can be made by those skilled in the art without departing from the spirit of the invention. Accordingly, it is intended that the scope of the invention be limited only by the claims which follow.

We claim:

1. A gas operated plunger for lifting well fluids from a subterranean reservoir to the surface through a well conduit which extends upwardly from said reservoir to said surface and which is provided near the lower end thereof with stop means, said plunger comprising:

a plunger body slidably mountable within said conduit having an upper portion, a lower portion and an intermediate cylindrical portion of reduced diameter, the outer surface of said intermediate portion and the inner walls of the well conduit in which said plunger is to be used defining a cylindrical space; and sealing means for disposition in said cylindrical space including an outer seal comprising a plurality of longitudinally divided cylindrical segments of relatively smooth exterior cylindrical surfaces for sliding and sealing contact with said well conduit walls and an inner annular flexible seal the interior of which sealingly engages said intermediate portion of said plunger body and the exterior of which sealingly engages interior surfaces of said outer seal cylindrical segments, said sealing means providing a seal which allows said plunger to gravitate through said well conduit to said reservoir and provides sufficient sealing upon an increase in gas pressure to elevate said plunger and said well fluids thereabove to said surface.

2. A gas operated plunger as set forth in claim 1 in which each of said cylindrical segments is radially moveable between an innermost position, in which said exterior cylindrical surfaces lie within a circle whose diameter is less than any restriction which may be encountered within said flow conduit, and an outermost position in which said exterior cylindrical surfaces slidingly and sealingly engage said well conduit walls.

3. A gas operated plunger as set forth in claim 2 including biasing means disposed between said cylindrical segments and said intermediate plunger body portion biasing said segments toward said outermost positions.

4. A gas operated plunger as set forth in claim 3 in which the upper and lower ends of said cylindrical segments are tapered so that upon engagement of either end of said cylindrical segments with a restriction in said well conduit said cylindrical segments will be forced inwardly toward said innermost position.

5. A gas operated plunger as set forth in claim 3 in which said biasing means comprises said annular flexible seal, said flexible seal comprising a body portion sealingly surrounding said intermediate plunger body portion and a downwardly and outwardly flaring skirt portion engaging said interior surfaces of said outer seal cylindrical segments, increased gas pressure below said plunger being translated through said skirt portion of said seal as an increased sealing and outwardly biasing force against said outer seal cylindrical segments.

6. A gas operated plunger as set forth in claim 3 in which said biasing means comprises spring members disposed between said outer seal cylindrical segments and said intermediate plunger body portion.

7. A gas operated plunger as set forth in claim 2 in which said outer seal comprises upper and lower retainer rings engageable with upper and lower ends of said cylindrical segments to maintain said segments around said intermediate portion of said plunger body and to limit radial movement thereof to said outermost position.

8. A gas operated plunger as set forth in claim 7 in which adjacent edges of adjacent ones of said cylindrical segments are provided with corresponding circumferentially and mutually engageable tabs and slots, a tab on one of said adjacent cylindrical segments and a slot on the other, to aid in guiding said cylindrical segments between said innermost and outermost positions.

9. A gas operated plunger as set forth in claim 8 in which said tabs and slots have stepped areas so that a portion of a tab overlaps a portion of said slot at all times between said innermost and outermost positions.

10. A gas operated plunger as set forth in claim 8 in which said tabs and slots are provided with overlapping opposing surfaces which are slidingly engageable with each other as said cylindrical segments move between said innermost and outermost positions.

11. A gas operated plunger as set forth in claim 10 in which said overlapping opposing surfaces are planar surfaces which are tangentially disposed relative to a cylinder whose axis corresponds with the axis of said intermediate cylindrical portion of said plunger body.

12. A gas operated plunger as set forth in claim 1 in which said plunger body has a longitudinal flow passage therethrough and a valve is attached to said lower portion of said plunger body, said valve having a flow passage in flow communication with said plunger body flow passage and a closure member moveable between an open position, in which fluid flow is permitted through said valve and plunger body flow passages, and a closed position in which fluid flow through said valve and plunger body flow passages is blocked allowing said increase in gas pressure to elevate said well fluids to said surface.

13. A gas operated plunger as set forth in claim 12 in which said valve comprises a valve body in which is provided said valve flow passage and a valve seat which is engageable by said closure member when in said closed position.

14. A gas operated plunger as set forth in claim 13 in which said valve body is provided with a pocket in which said closure member is disposed when in said open position so as not to interfere with fluid flow through said valve flow passage.

15. A gas operated plunger as set forth in claim 14 in which said valve includes activator means engageable with said closure member and moveable in response to a force applied thereto to move said closure member from said open position in said pocket to said closed position sealingly engaging said valve seat.

16. A gas operated plunger as set forth in claim 14 in which said valve includes an actuator member one end of which is engageable with said closure member and the other end of which is engageable with said stop means as said plunger gravitates downwardly in said conduit to move said closure member from said open position in said pocket to said closed position.

17. A gas operated plunger as set forth in claim 16 including biasing means engaging said actuator member biasing said actuator member away from moving said closure member to said closed position.

18. A gas operated plunger as set forth in claim 13 in which said valve body is threadedly attached to said lower portion of said plunger body allowing removable of said valve for repair or replacement of the components thereof.

* * * * *